US010388154B1

(12) United States Patent
Kuzikov et al.

(10) Patent No.: US 10,388,154 B1
(45) Date of Patent: Aug. 20, 2019

(54) VIRTUAL INDUCTION LOOPS FOR ADAPTIVE SIGNALIZED INTERSECTIONS

(71) Applicants: VOLKSWAGEN AG, Wolfsburg (DE); PORSCHE AG, Stuttgart (DE); AUDI AG, Ingolstadt (DE)

(72) Inventors: Dmitriy Kuzikov, Kösching (DE); Michael Zweck, Gaimersheim (DE); Christoph Rucker, Ingolstadt (DE); Joerg Christian Wolf, Foster City, CA (US)

(73) Assignees: Volkswagen AG (DE); Audi AG (DE); Porsche AG (DE)

( * ) Notice: Subject to any disclaimer, the term of this patent is extended or adjusted under 35 U.S.C. 154(b) by 0 days.

(21) Appl. No.: 16/025,469

(22) Filed: Jul. 2, 2018

(51) Int. Cl.

| | |
|---|---|
| ***G08G 1/095*** | (2006.01) |
| ***G08G 1/07*** | (2006.01) |
| ***G08G 1/13*** | (2006.01) |
| ***G08G 1/01*** | (2006.01) |

(52) U.S. Cl.
CPC ..... *G08G 1/07* (2013.01); *G08G 1/0112* (2013.01); *G08G 1/0145* (2013.01); *G08G 1/13* (2013.01)

(58) Field of Classification Search
CPC ..... G08G 1/07; G08B 21/00
USPC ..... 340/907, 905, 909, 670, 934, 995.14; 701/36, 70, 201, 208, 400
See application file for complete search history.

(56) References Cited

U.S. PATENT DOCUMENTS

| | | | | |
|---|---|---|---|---|
| 2013/0110316 | A1* | 5/2013 | Ogawa | G08G 1/096716 701/1 |
| 2015/0029039 | A1* | 1/2015 | Mukaiyama | G08G 1/096716 340/905 |
| 2015/0060350 | A1* | 3/2015 | Savage | A47J 37/1223 210/416.5 |
| 2016/0148508 | A1* | 5/2016 | Morimoto | G08G 1/096 701/117 |
| 2017/0089717 | A1* | 3/2017 | White | G01C 21/3658 |

FOREIGN PATENT DOCUMENTS

| | | | |
|---|---|---|---|
| DE | 102012211620 | A1 | 1/2013 |
| DE | 102015122893 | A1 | 6/2017 |
| EP | 1916643 | A1 | 4/2008 |

OTHER PUBLICATIONS

Albertengo et al.; Virtual induction loops using smartphones for urban traffic control systems; Transportation Research Procedia; 2016.

Gramaglia et al.; Virtual Induction Loops Based on Cooperative Vehicular Communications; Sensors (Basel); vol. 13, No. 2; 2013; pp. 1467-1476.

* cited by examiner

*Primary Examiner* — Tai T Nguyen
(74) *Attorney, Agent, or Firm* — Barnes & Thornburg LLP

(57) ABSTRACT

A system and method are provided for controlling traffic signals using virtual induction loops. The system allows bidirectional communication between a traffic signal controller and a vehicle so that the controller can send map data to the vehicle and the vehicle can send a recall message to the controller, requesting to be served by the controller at an approaching traffic signal.

20 Claims, 9 Drawing Sheets

VIRTUAL INDUCTION LOOPS FOR ADAPTIVE SIGNALIZED INTERSECTIONS

BACKGROUND

The present disclosure relates to systems, components, and methodologies for adaptively controlling traffic light signals. More particularly, the present disclosure relates to systems, components and methodologies for controlling traffic signal behavior with virtual induction loops.

SUMMARY

Accordingly, systems, components and methodologies are provided for adaptively controlling traffic light signals using bidirectional communications with one or more approaching vehicles. By communicating with the approaching vehicle, the status of that vehicle relative to the intersection may be continuously updated via recall messages and cancellation messages, thereby allowing the traffic light controller to integrate this information into its control scheme to more effectively regulate traffic at the intersection.

According to at least one disclosed embodiment, the system may comprise a virtual induction loop system including a transportation vehicle, a traffic light control system, a traffic light control system in communication with the vehicle that communicates a map message to the vehicle including lane geometry at an intersection, and, means for analyzing the map and the position of the vehicle and issuing a recall message from the vehicle to the traffic light control system so that the traffic light control system can account for the vehicle in the control of a traffic light at the intersection.

In some embodiments, the means may comprise a processor in the vehicle, the processor configured to include a transceiver to communicate directly with a road side unit that controls the traffic signal. In some embodiments, the means may comprise a processor in the vehicle, the processor configured to include a transceiver to communicate with a traffic management center via an existing vehicle manufacturer communication network.

In some embodiments, the map message may include a virtual loop positioned in a predetermined location relative to the intersection and the means may determine that the vehicle has crossed the virtual loop and issue a recall message in response to that determination. In some embodiments, the means determines an estimated time of arrival ("ETA") to the intersection and the recall message includes the ETA.

According to some embodiments, the vehicle may continuously monitor the vehicle position and the information in the map message and may send updated recall messages, including cancellation messages, when the vehicle deviates from approaching the intersection.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Traffic control devices, such as traffic signals, provide important guidance and communication for roadway vehicle operations. However, even properly implemented traffic control devices can create inefficiencies. For example, a typical-phase (red, amber, green) traffic light can generate vehicle and/or traffic inefficiencies due to failure to properly account for real-time traffic situations in the traffic signal's controller program. Induction loops and "video loops' are fixed installations at actuated signalized intersections that can detect vehicles and let the controller know a vehicle is approaching. However, these fixed detection installations must be installed in close proximity to the intersection, often providing too little time for the controller to integrate the approaching vehicle information into its traffic light control program. By providing a virtual induction loop, the virtual induction loop may be placed or even repositioned without the expense of modification of the roadway and irrespective of whether the stoplight or stoplight camera is within view of the location of the virtual induction loop. In this manner, an approaching vehicle can issue a recall (also referred to as a call) message requesting to be served well in advance of arriving at the traffic signal.

Figure 1:
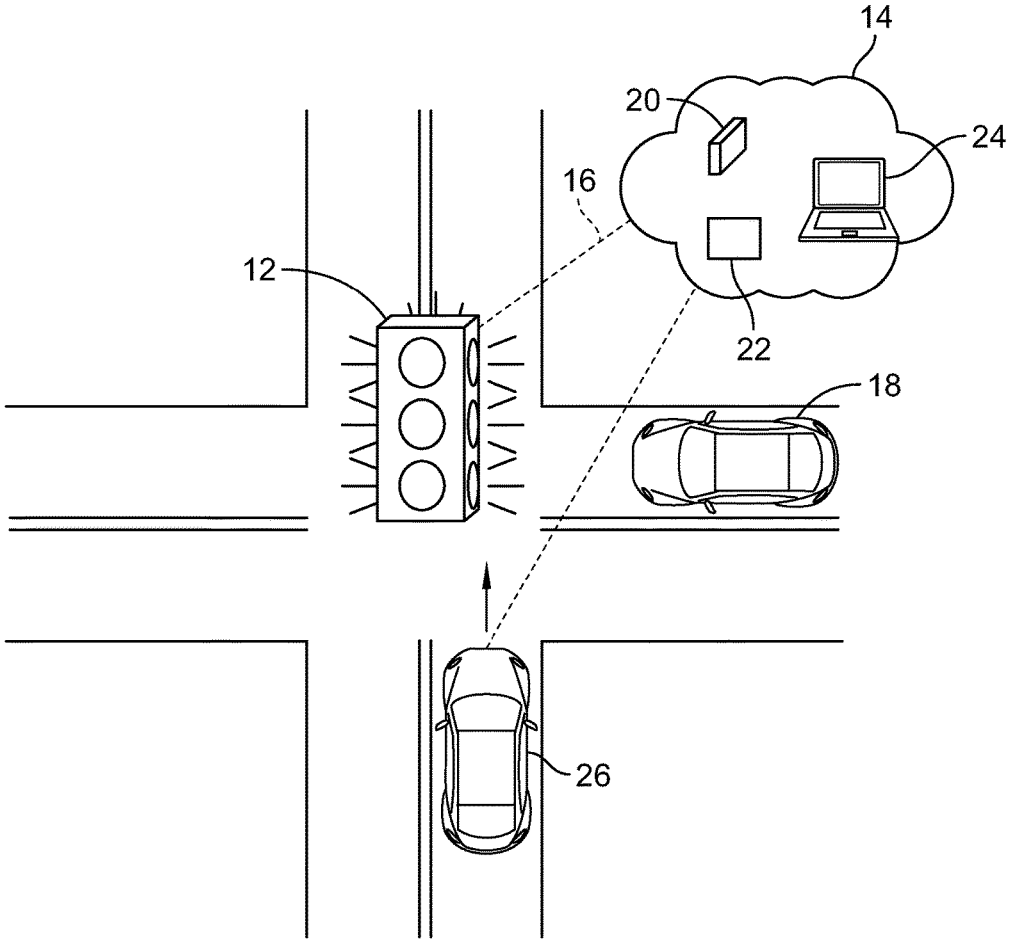
FIG. 1 is an overhead plan view of a roadway traffic intersection showing a traffic signal for conducting traffic through the intersection and a computer network in communication between a vehicle on the roadway and the traffic signal to provide a topology map to the vehicle and a recall message to the traffic signal to facilitate control and operation of the traffic signal.

As shown in FIG. 1, a traffic light 12 is oriented to govern the flow of traffic through a roadway intersection. The traffic light 12 may be a portion of a traffic system of the surrounding area. The traffic system may include numerous traffic lights, indicators, signs, and/or other traffic control devices. The traffic system may be in communication with a network 14 to communicate traffic information, as represented by communication link 16 between the traffic light 12 and the network 14, although traffic information may be communicated through devices of the traffic system other than the traffic light 12 itself, for example, through a communication hub. Traffic information may include light phases (i.e., red, yellow, green), phase timing, triggering of detectors (e.g., pedestrian crosswalk request buttons), intersection topology information, and/or other intersection and/or traffic related information.

The network 14 may be formed as a data collection and/or processing center. The network 14 may include various processors 20, databases 22, terminals 24, and/or other hardware and/or or software for data collection and/or processing. The processors 20 may execute instructions for triggering a virtual loop and may communicate with the various databases 22, terminals 24, and/or other components to achieve their functions. The network 14 may be programmed to control and adjust operation of the traffic signal 12 based on information received from the traffic system, including information about an approaching vehicle 26. For example, the operation of the traffic signal may be adjusted to extend the green light signal for an approaching vehicle 26 in motion while maintaining a red light for another stopped vehicle 18.

Figure 2:
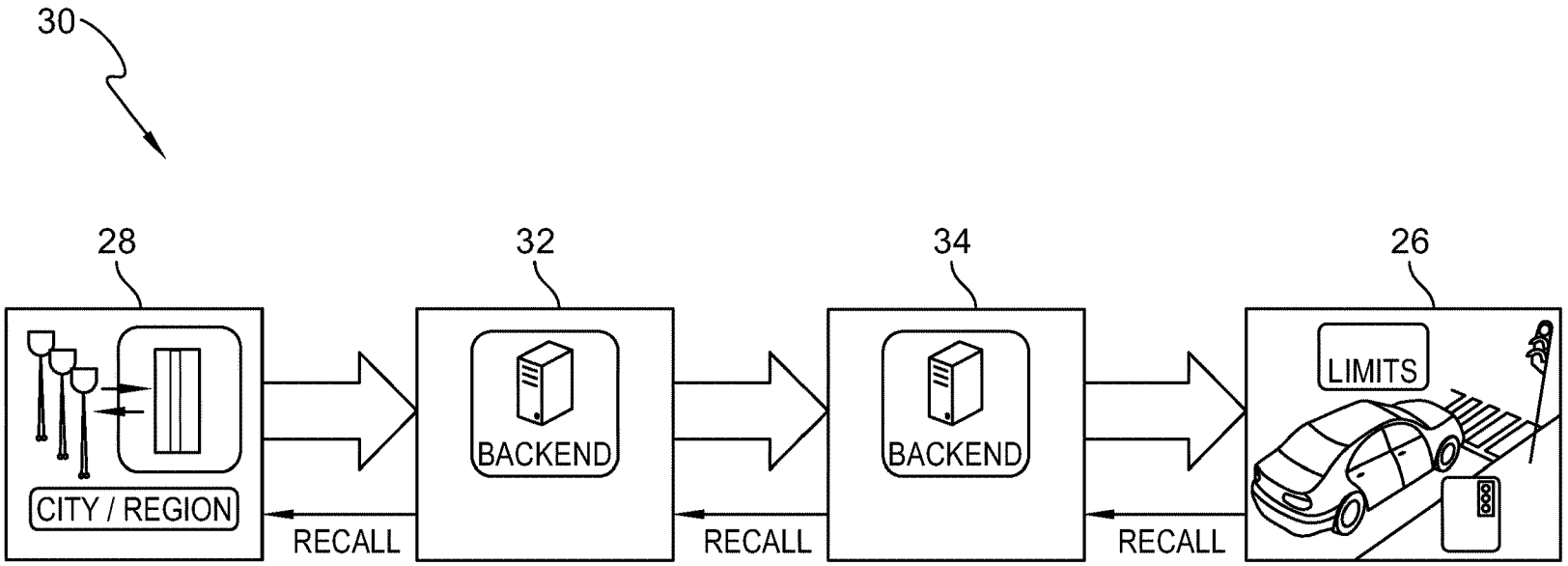
FIG. 2 is a two-way process flow chart of the communication of FIG. 1 showing that a traffic network communicates map information related to the traffic signal and a virtual loop associated with the traffic signal with content providers of the computer network which communicate with the vehicle, the vehicle in turn issuing a recall message when the virtual loop has been crossed.

Referring now to FIG. 2, a flow is illustrated for developing and implementing virtual loop control of the operation of the traffic light 12 using a bidirectional datapath. The traffic system 28 may communicate intersection topology map information including a signal identifier and the position of a virtual loop for the signal. The map topology may further include map lines to define each lane extending from the last traffic signal traversed to the stop line at the approaching intersection as discussed further in FIG. 4D The virtual loop control system 30 may be provided by a single content provider 32 or may be provided in collaboration with an optional additional content providers 34, and may include the vehicle 26. The content provider 32, 34 may communicate map information, including the location of a virtual loop in the map corresponding to traffic light 12 to the vehicle 26. The vehicle may be configured to process the received information by continuously comparing the map information received with the real-time vehicle position and provide a recall message based on the received map information to the content provider 32, 34 and back to the traffic system 28 to control the traffic signal.

Figure 3A:
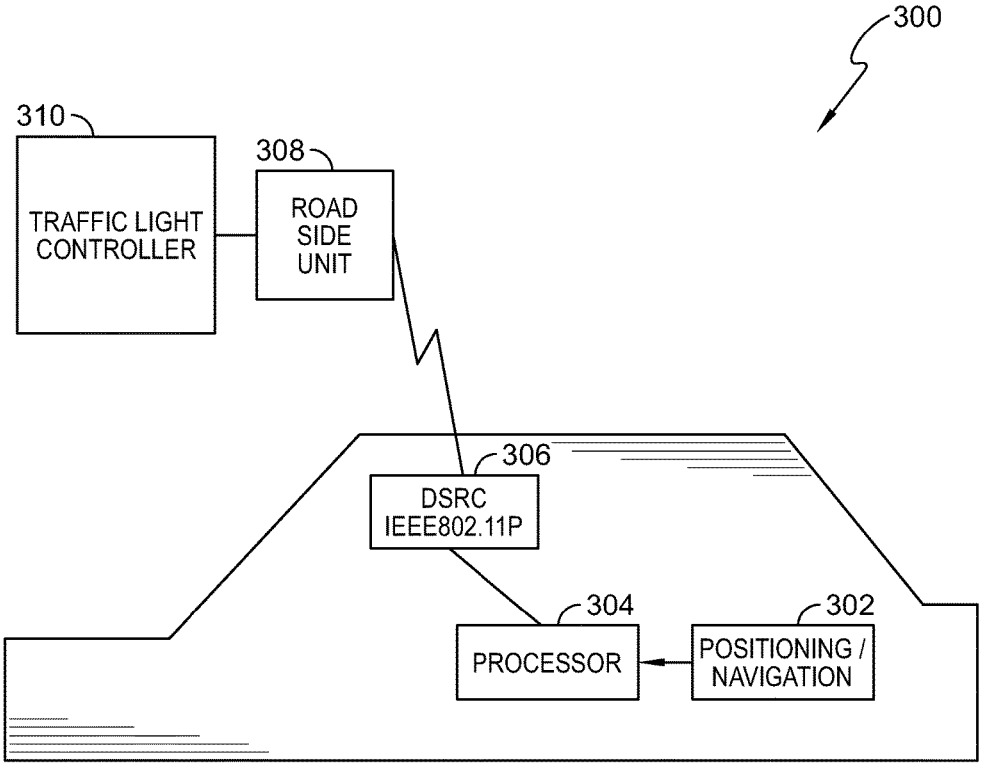
FIG. 3A is a diagrammatic view of one embodiment of a virtual induction loop system in which the vehicle is in two-way communication with a traffic light controller via DSRC.
Figure 3B:
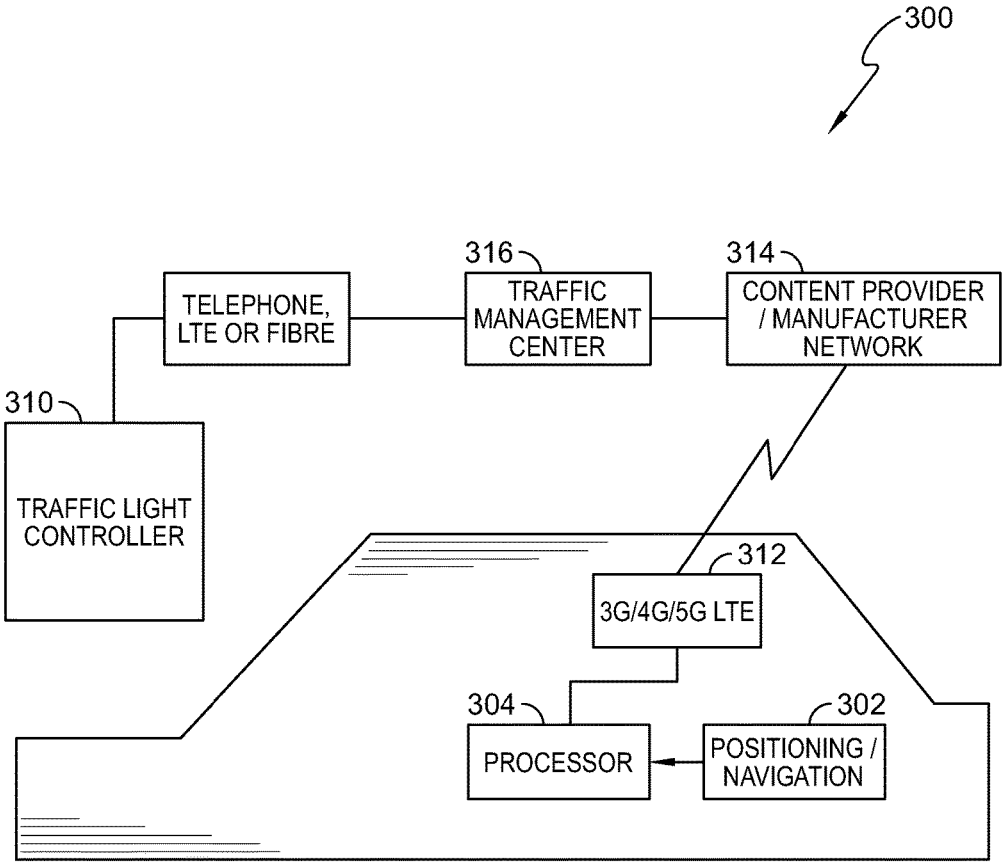
FIG. 3B is a diagrammatic view of another embodiment of a virtual induction loop system in which the vehicle is in two-way communication with a traffic light controller via a vehicle content provider network in communication with a traffic management center.

Vehicle embodiments for implementing this bidirectional datapath are illustrated in FIGS. 3A-3B. As seen in FIG. 3A, a vehicle 300 may be provided with a positioning or navigation system 302 in communication with a processor 304 that may be configured to receive and process information from the positioning system 302 and a traffic light controller 310. The vehicle 300 may be communicatively connected to the traffic light controller 310 via dedicated short-range communications (DSRC) with a road side unit 308, such as the SAE J2735 Standard. Alternatively, vehicle 300 may be connected through 3G/4G/5G LTE communications 312 via a vehicle content provider or manufacturer network 314 o a traffic management center 316. Traffic management center 613 may be in further wired or wireless communication with one or more traffic light controllers 310. This alternative bidirectional connectivity can be done, for example, via the Audi Connect Traffic Light Information System as disclosed in U.S. Ser. No. 15/881,905, which is incorporated in its entirety by reference. In another edge computing embodiment (not shown), the content provider network may be local, such as a computer placed at the traffic management center or near a 4G/5G cellular tower to minimize latency.

Figure 4A:
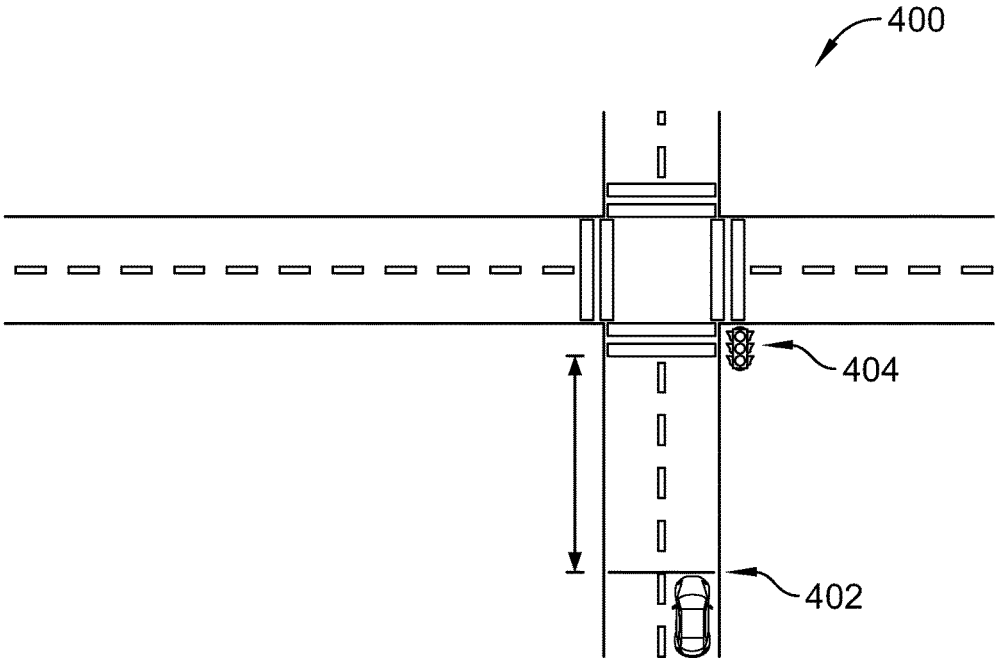
FIG. 4A is an overhead view of one example of a virtual induction loop designed as a virtual loop line extending across all lanes of traffic.
Figure 4B:
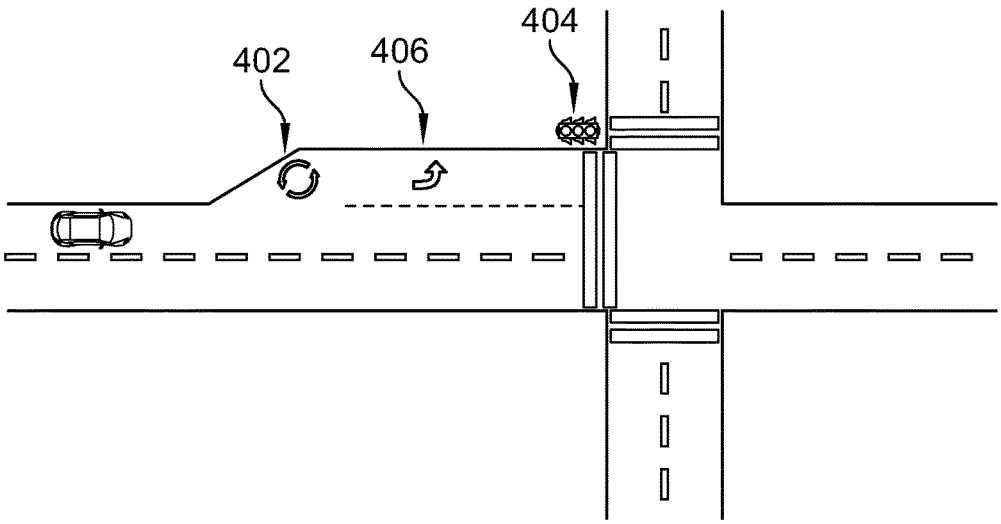
FIG. 4B is an overhead view of another example of a virtual induction loop designed as a virtual loop positioned in a lane branch forming a turning lane.
Figure 4C:
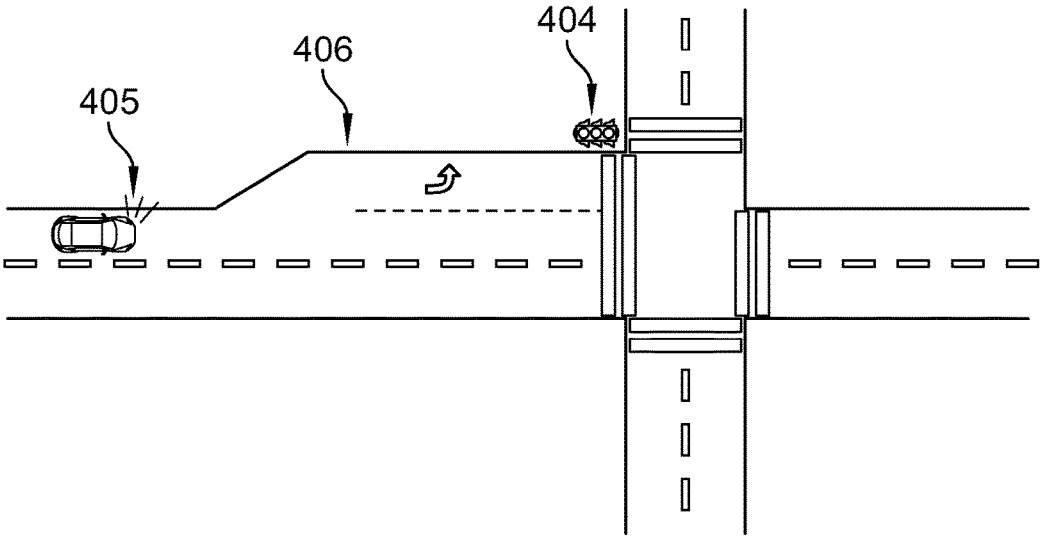
FIG. 4C is an overhead view of another example of a virtual induction loop designed as a combination of a lane branch forming a turning lane and a turn signal indicator.
Figure 4D:
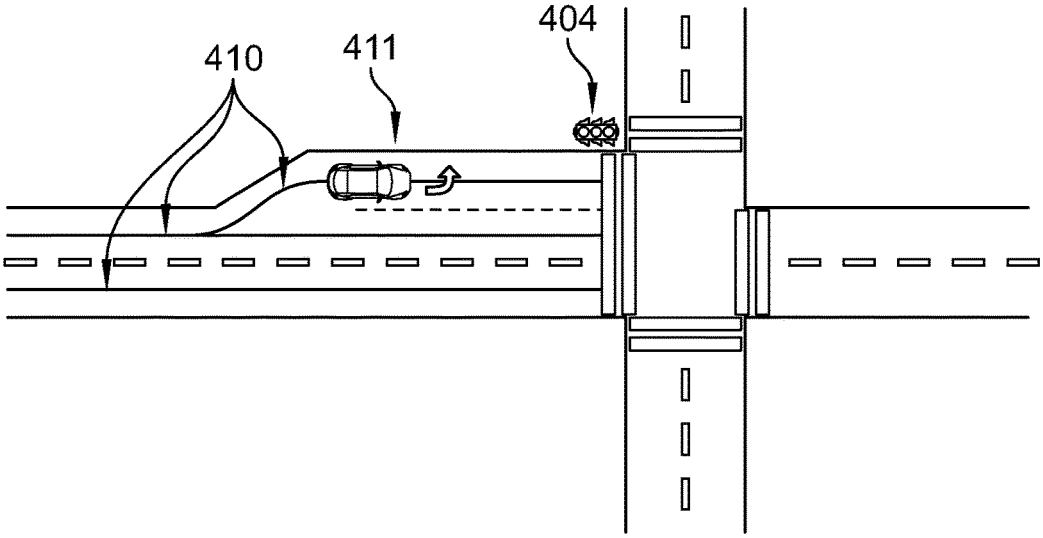
FIG. 4D is an overhead view of another example of a virtual induction loop designed as a combination of lane center lines defining a turning lane and an estimated time of intersection arrival.
Figure 4E:
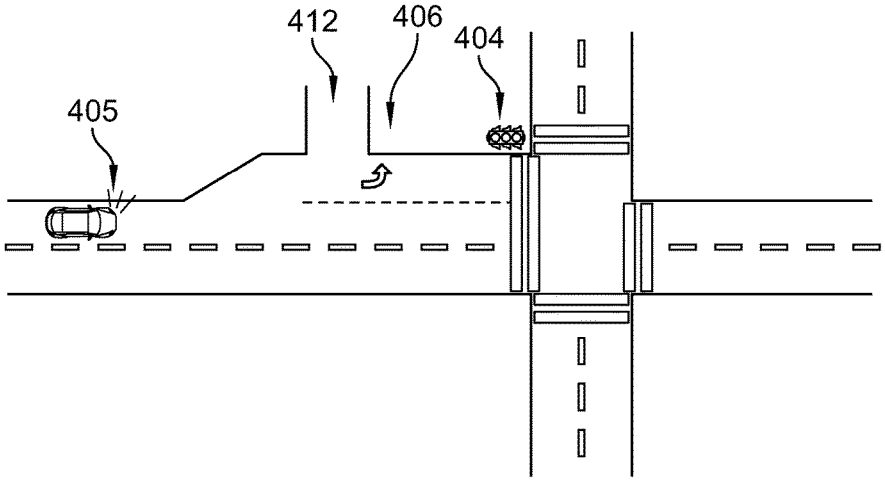
FIG. 4E is an overhead view of a virtual induction loop of FIG. 4C with a detour from the intersection in the turning lane.

As discussed above, the traffic light controller is configured to transmit a map or topology message to a vehicle. The map or topology message may include information regarding the lane geometry at the intersection, a corresponding signal group and movement, and location of a virtual loop for a traffic signal. Exemplary embodiments of various virtual loop scenarios are provided in FIGS. 4A-4E. As seen in FIG. 4A, there are no turn lanes at the intersection 400. In this embodiment, virtual loop 402, may be a line across all lanes approaching the intersection as all lanes may be governed by the same traffic signal 404. FIG. 4B illustrates an embodiment in which a virtual loop 402 is positioned within an entry into a turn lane 406 to control a corresponding turn lane traffic signal 404 of a traffic signal group at an intersection. As seen in FIG. 4C, the virtual induction loop may be formed as a combination of identification of a turn signal 405 being activated in the approaching vehicle and a corresponding turn lane 406 to control a corresponding turn lane traffic signal 404. As seen in FIG. 4D, the topology map of the intersection may include lane geometries defined by a center line 410 for each lane present at the intersection. In this manner, each lane may be mapped to a particular traffic light in a signal group. Each lane geometry may be defined to extend from the previously encountered intersection to a stop, or limit line, at an approaching intersection. The virtual loop for a turn lane may be triggered when it is determined that the vehicle is in the turn lane, or positioned on the turn lane center line 411, to control the corresponding turn lane traffic signal 404. FIG. 4E shows an exemplary embodiment in which the recall signal may be updated. In this example, virtual loop may be a combination of the turn signal indicator 405 may be activated in vicinity of an oncoming turn lane 406 similar to FIG. 4C. A recall message may be sent by the vehicle to control the traffic signal when the turn signal is activated as discussed above with respect to FIG. 2. However, an additional turn path, 412, such as an entry to a retail center, gas station, or other roadway may be positioned before the traffic signal 404. In this scenario, the vehicle may turn onto this additional turn path 412 prior to the intersection, in which case another recall message, or cancellation message, may be sent to the traffic signal control to update the traffic situation. Although depicted as distinct virtual loop scenarios for the purposes of discussion, any of these embodiments may be present in combination at an intersection.

Figure 5:
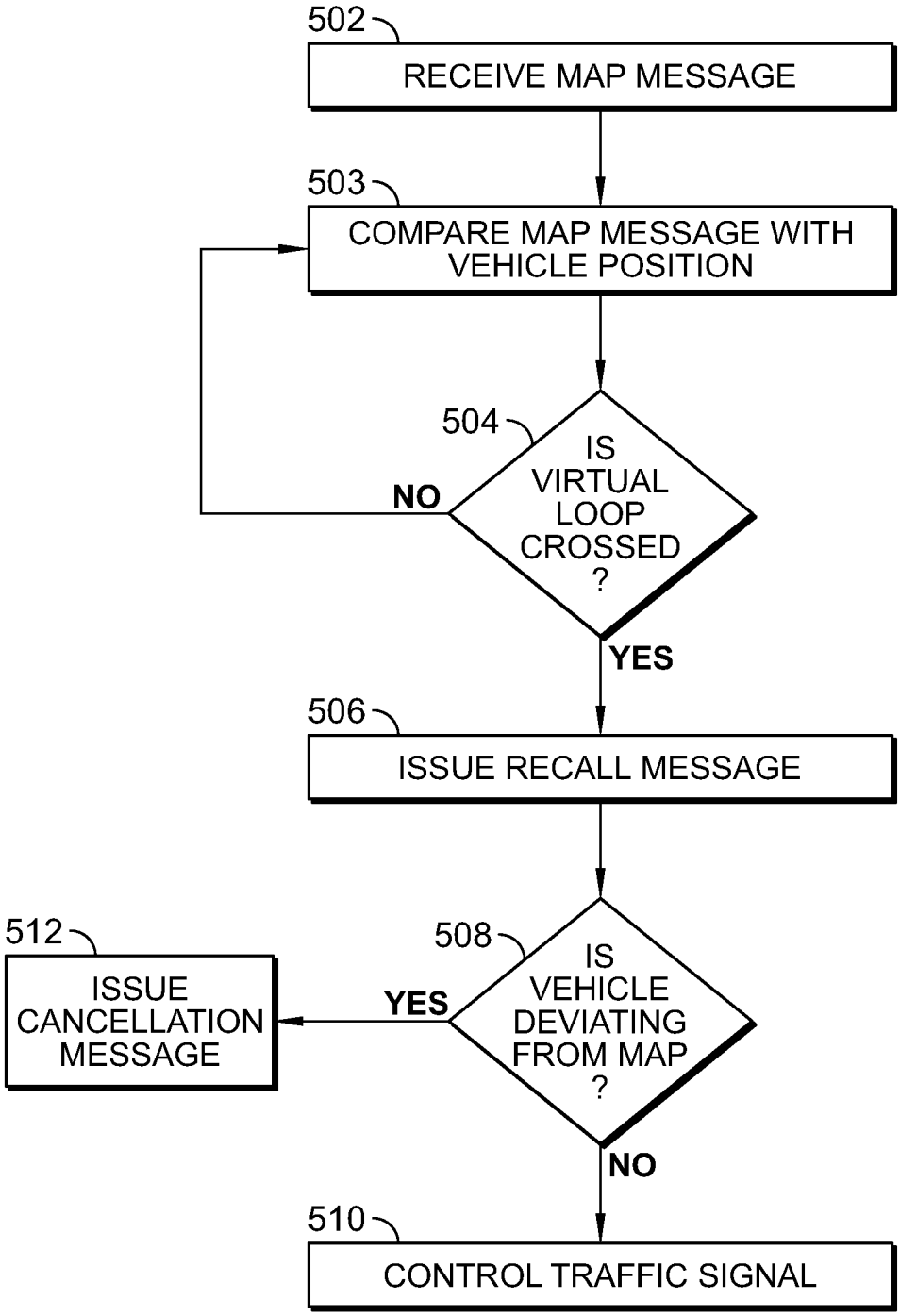
FIG. 5 is a diagrammatic flow chart of a method for adaptively controlling a traffic signal based on received virtual loop information at the vehicle.

A method of controlling a traffic light system using virtual loops is provided in FIG. 5. A vehicle receives a map message 502, which includes topology information about lanes in an upcoming intersection as well as a virtual loop position. The map may be sent by the road side unit or content provider to be transmitted to the vehicle as discussed above with respect to FIGS. 2, 3A-3B. The vehicle continuously determines whether the virtual loop has been crossed 504. This may be performed by comparing the position of the vehicle with the position of the virtual loop in the map message. If the loop has not been crossed, the vehicle may continue to compare the position of the vehicle with the virtual loop message until the loop is crossed. In response to a determination that the virtual loop is crossed, a recall message may be issued 506. The recall message may be issued through the network as disclosed in FIG. 2 for example and routed back to the traffic light controller. The recall message may include identifiers that allow the message to be routed back to the correct traffic light controller. For example, identifiers may include a traffic light identifier, a direction of travel of the vehicle, and a lane identifier of the vehicle. The vehicle may continue to monitor the position of the vehicle in the received map message. If the vehicle deviates from the information indicated in the map message 508, an additional recall message, or cancellation message 512, may be sent to cancel the request to be served at the intersection. This may occur when the vehicle turns or in some other way deviates its travel path to avoid the approaching intersection. If the vehicle does not deviate from the information indicated in the recall message, then the traffic light controller receives the recall message and uses the message for controlling the traffic light 510.

Figure 6:
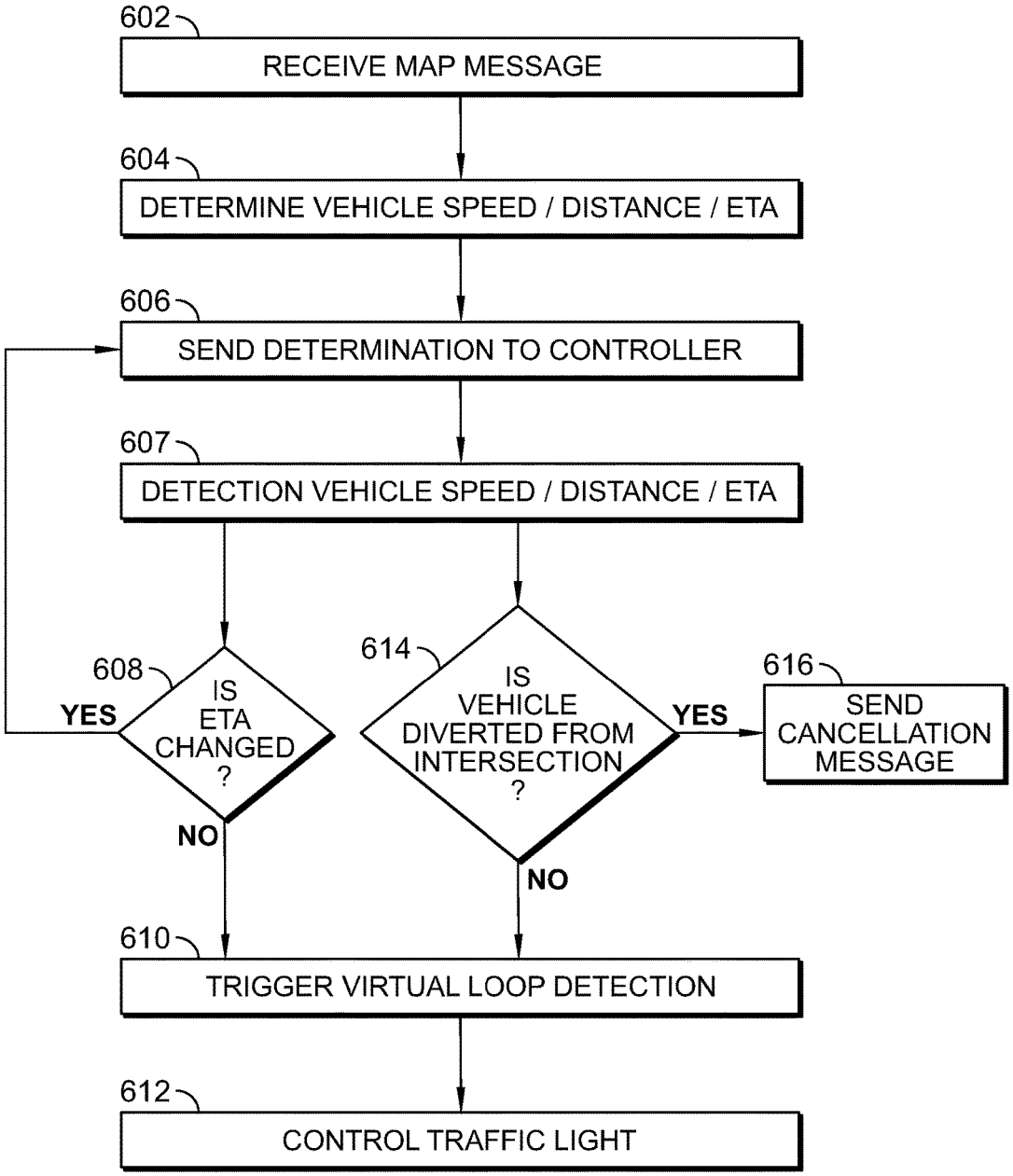
FIG. 6 is a diagrammatic flow chart of a method for adaptively controlling a traffic signal based on received estimated time of arrival data at the traffic light controller.

A method of controlling a traffic light system using virtual loops is provided in FIG. 6. A vehicle receives a map message 602, which includes topology information about lanes in an upcoming intersection as well as a virtual loop position. The map may be sent by the road side unit or content provider as discussed above with respect to FIGS. 2, 3A-3B. The vehicle processes the map message to determine one or more of an estimated time of arrival at the intersection, a distance to the intersection and a speed the vehicle is traveling at 604. The vehicle sends a recall message to the controller with the determined information 606 indicating when the vehicle will arrive at the intersection. The vehicle continuously monitors distance and speed to determine if the estimated time of arrival has changed 608. If it has, the vehicle sends this change in an updated recall message to the controller 606. If the estimated time of arrival has not changed, then the traffic light controller triggers a virtual loop detector operation at a time that is optimal for the approaching vehicle based on the latest received recall message. 610. This may then permit the information about the time of the approaching vehicle to be integrated into the program to control the traffic light 612. Concurrently with determining whether the estimated time of arrival has changed 608, the vehicle may determine whether the vehicle has diverted from a path to the intersection 614. If the vehicle deviates from the map information, such as lane information leading to the intersection, an additional recall message, or cancellation message 616, may be sent to cancel the request to be served at the intersection. This may occur when the vehicle turns or in some other way deviates its travel path to avoid the approaching intersection. If the vehicle does not deviate from the information indicated in the recall message, then the traffic light controller reacts to the recall message to control the traffic light 610, 612.

As described in the systems and methods above, controlling the traffic light may include changing the timing of phases (red/green time) by extending the green-light time for an approaching vehicle or, providing a green indicated if there is no traffic in conflicting directions. In some embodiments, the controlling may include not altering the timing phases in view of the approaching vehicle due to other pre-programmed traffic considerations. For the purposes of this disclosure, recall is not used to mean pre-emption, which is a mode that gives priority to emergency vehicles. Rather, the recall message is integrated in the pre-existing controller program of a traffic light.

In some embodiments, the vehicle recall message may include vehicle weight and/or type and the controller program of the traffic light may be configured to give priority (longer and earlier green light time) to heavy vehicles, tractor trailers, or public transportation vehicles. In some embodiments, a plurality of vehicles may be organized into a platoon by V2V communication. A vehicle in the platoon may convey a platoon identification, the number of vehicles, and vehicle types in the recall message. The traffic light controller may be programmed to integrate platoon information into its traffic light control program to more efficiently manage traffic, for example, by extending the length of green light time so that the entire platoon may traverse the intersection.

Previously existing detector installations for vehicle induction loops are fixed and often installed in close proximity to the intersection. Systems including cameras must be installed within the direct view of the intersection. Maintenance associated with these detector systems is expensive and can involve going to the intersection and cutting slots in the road. Various control systems for public transportation, such as trains, rely on predetermined routes and time schedules to prioritize the public transport based on these known predetermined variables.

The virtual loop system uses a software-defined detector whose can be defined and changed easily in software and at little or no cost. Therefore, if a defined detector, or "virtual loop" is providing inadequate response time or information to a traffic light control system, it can be redefined in the software to either change distance within lanes or to be limited to one or more particular lanes. Additionally, this software-defined detector may be installed further away from an intersection giving the traffic light control a more advanced warning of approaching vehicles. Furthermore, call, recall, updated recall or cancellation messages may be transmitted from a vehicle with a randomly assigned temporary ID so that the content provider and the traffic light controller can associate the messages to the vehicle and associates which recall messages correspond to a cancellation message. Still further, the system communication infrastructure that allows constant bidirectional communication including updates in speed, direction, and time of arrival in real time so that the system can account for and react to general traffic and changes in traffic in real time. This results in a smoother flow of traffic by ensuring the system has sufficient time to respond to the approaching vehicle.

It should be understood that some or all of the methodology explained above may be performed on, utilizing or with access to one or more servers, processors and associated memory. Unless specifically stated otherwise, and as may be apparent from the above description, it should be appreciated that throughout the specification descriptions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Although certain embodiments have been described and illustrated in exemplary forms with a certain degree of particularity, it is noted that the description and illustrations have been made by way of example only. Numerous changes in the details of construction, combination, and arrangement of parts and operations may be made. Accordingly, such changes are intended to be included within the scope of the disclosure, the protected scope of which is defined by the claims.

The invention claimed is:

1. A virtual induction loop system comprising:

a vehicle, a traffic light control system in communication with the vehicle that communicates a map message to the vehicle including lane geometry at an intersection, and a traffic light module in the vehicle for analyzing the map and a position of the vehicle and issuing a recall message from the vehicle to the traffic light control system so that the traffic light control system can account for the vehicle in a control of a traffic light at the intersection.

2. The system of claim 1, wherein traffic light module is configured to compare the position of the vehicle with a virtual loop in the map message.

3. The system of claim 1, wherein traffic light module is configured to compare the position of the vehicle with a traffic light limit line and the recall message includes an estimated time of arrival to the traffic light limit line.

4. The system of claim 3, wherein the traffic light module is configured to continuously monitor the estimated time of arrival and send an updated recall message in response to a change in estimated time of arrival exceeding a predefined threshold.

5. The system of claim 3 wherein the traffic light control system initiates a virtual loop crossing protocol in response to a determination that the vehicle will be arriving at the intersection within a threshold period of time determined by the received estimated time of arrival.

6. The system of claim 2, wherein the traffic light module is further configured to compare the position of the vehicle with topographical lane lines in the map message and the recall message indicates the lane the vehicle will be in at the intersection.

7. The system of claim 6, wherein the traffic light module is further configured to receive turn signal indicator inputs from the vehicle.

8. The system of claim 2, wherein the traffic light module is further configured to send a cancellation message to the traffic light control system in response to a determination that the vehicle is no longer approaching the intersection.

9. The system of claim 8, wherein the traffic light control system is configured to receive the recall message and incorporate the approaching vehicle information into a pre-existing traffic light control scheme.

10. The system of claim 1, wherein the traffic light control system is configured to be adjustably programmable to change a location of a virtual loop in the map.

11. The system of claim 10, wherein the traffic light control system is configured to place the virtual loop at a position on the map that is not viewable at the position of the traffic light.

12. A control for monitoring vehicle positioning and communicating with a traffic light control system, the control comprising: a processor including programmable instructions that when executed cause the processor to receive a topology map from a traffic light control system, receive navigational data indicative of a current position of the vehicle, continuously identify and update the position of the vehicle relative to a predefined virtual loop on the topology map, and transmit a recall message to the traffic light control system in response to the vehicle position aligning with or crossing over the virtual loop, the recall message requesting service of a traffic light that the vehicle is approaching, wherein the processor includes a transceiver to transmit the recall message to the traffic light control system.

13. The control of claim 12, wherein the recall message includes vehicle position, speed, and a traffic light identifier.

14. The control of claim 12, wherein the control submits a cancellation message to the traffic light system in response to a deviation of the vehicle from a path to the traffic light after the recall message is transmitted.

15. The control of claim 12, wherein the processor is further configured to evaluate the topology map and the recall message includes an indication of which lane the vehicle will be in at the approaching intersection.

16. A method for controlling a traffic light system using virtual loops, the method comprising:

transmitting a topology map to a vehicle, the topology map including lane indicators, virtual loop indicators, and traffic lights from a network, continuously comparing a position of the vehicle to a position of a virtual loop indicator on the topology map via a processor in the vehicle, and generating a recall message in the vehicle in response to the vehicle crossing the virtual loop indicator and transmitting it to a traffic light system to control one of the traffic lights.

17. The method of claim 16, wherein the traffic light system controls the traffic light based, at least in part, on the recall message.

18. The method of claim 16, further comprising continuously comparing the position of the vehicle to the lane indicators, and generating a cancellation message in the vehicle in response to the vehicle deviating from the lane indicators and transmitting it to the traffic light system to update the control of the traffic light.

19. The method of claim 16, wherein the recall message includes a vehicle lane position identifier and a traffic light identifier.

20. The method of claim 16 wherein the traffic light system integrates the recall message information into a pre-existing traffic light control protocol configured to maintain efficient traffic flow at the intersection.

* * * * *